US005746528A

United States Patent [19]

Mayer et al.

[11] Patent Number: 5,746,528

[45] Date of Patent: May 5, 1998

[54] HARD COPY APPARATUS WITH A PRINT MEDIA TELESCOPING TRAY SYSTEM

[75] Inventors: Jeremy Mayer; Juan B. Belon; A. Terence Kennedy, all of San Diego, Calif.

[73] Assignee: Hewlett-Packard Company, Palo Alto, Calif.

[21] Appl. No.: 806,589

[22] Filed: Feb. 26, 1997

[51] Int. Cl.[6] ..... B41J 11/58

[52] U.S. Cl. ..... 400/625; 400/624; 271/3.14; 271/4.01; 271/164; 271/171

[58] Field of Search ..... 400/625, 642, 400/624, 647, 647.1; 271/3.14, 4.01, 9.11, 164, 171, 207; 399/393, 389

[56] References Cited

U.S. PATENT DOCUMENTS

| | | | |
|---|---|---|---|
| 4,728,963 | 3/1988 | Rasmussen et al. | 346/25 |
| 5,065,197 | 11/1991 | Misuyama | 399/393 |
| 5,110,111 | 5/1992 | Gompertz et al. | 271/186 |
| 5,201,505 | 4/1993 | Shah | 271/3.14 |
| 5,299,875 | 4/1994 | Hock et al. | 400/625 |
| 5,320,338 | 6/1994 | Shinohara et al. | 271/164 |
| 5,377,966 | 1/1995 | Ohmori | 271/4.01 |
| 5,434,660 | 7/1995 | Yoshida et al. | 271/207 |
| 5,461,408 | 10/1995 | Giles et al. | 347/102 |
| 5,573,236 | 11/1996 | Petocchi et al. | 271/171 |
| 5,603,493 | 2/1997 | Kelly | 347/104 |
| 5,620,269 | 4/1997 | Gustafson | 347/104 |

*Primary Examiner*—Edgar S. Burr
*Assistant Examiner*—Anthony H. Nguyen

[57] ABSTRACT

A hard copy apparatus with a print media telescoping tray system is disclosed. The telescoping tray system consists of an output tray, a paper tray, and an output tray position detector. The trays are constrained to translate in one line of motion, a substantially planar path into and out of the front of the apparatus, by nesting the paper tray within the output tray and guiding the trays along the line of motion. The trays telescope in a relatively small vertical opening below the paper feed drive mechanism of the apparatus. The telescoping tray system enables two modes of printing operation by providing a paper output path when in the output tray closed mode and by providing a full tray where printed sheets can be stacked during a multi-sheet or batch print job in an output tray open mode.

20 Claims, 9 Drawing Sheets

HARD COPY APPARATUS WITH A PRINT MEDIA TELESCOPING TRAY SYSTEM

BACKGROUND OF THE INVENTION

1. Field of the Invention

The present invention relates generally to hard copy apparatus, more particularly to print media handling, input and output, and, specifically to a telescoping tray system.

2. Description of Related Art

A variety of cut-sheet print media handling systems used with hard copy apparatus are known in the art. For example, U.S. Pat. No. 4,728,963 (Rasmussen et al.; assigned to the common assignee of the present invention) for a SINGLE SHEET INK-JET PRINTER WITH PASSIVE DRYING SYSTEM teaches an ink-jet printer having both a paper supply tray 12 (also referred to in the art as an "input tray") and a paper collection tray 18 (also known in the art as an "output tray," or "catch bin") vertically stacked and protruding from the front of a printer 10. A supply of cut sheet media is loaded in a supply tray 12 at the lower front of the printer 10 where it is accessible by the printer's pick and feed mechanism. Printed output media is ejected into the collection tray 18 at the upper front of the printer 10. Such systems provide ease of media handling, particularly in replenishing the supply tray 12 and removing printed sheets from the collection tray 18. This system is common in the Hewlett-Packard™ DeskJet™ series of ink-jet printers. However, printer height is increased in order to accommodate the vertically stacked trays.

Another similar system is taught in U.S. Pat. No. 5,461,408 (Giles et al.; assigned to the common assignee of the present invention) for a DUAL FEED PAPER PATH FOR INK-JET PRINTER. An additional manual-feed tray and path is provided for guiding a single, manually fed, sheet or envelope from an inlet slot near the top, rear corner of the printer to a path converging location with the primary paper feed path. This system adds a requirement for the user to have rear access to the machine, increasing the effective work space needed to accommodate the machine (known in the art as the machine's "footprint").

Yet another media handling system is taught in U.S. Pat. No. 5,299,875 (Hock et al.; assigned to the common assignee of the present invention), METHOD AND APPARATUS FOR SEPARATING SHEETS EMERGING FROM A PRINTER, where a very small work space footprint is achieved in a portable ink-jet printer. As best seen in FIGS. 37, 39 and 43–47, the media is fed from an upwardly tilted input tray toward the rear of the unit and the printed output is essentially dumped onto the work surface where the printer is set up; that is, no full output tray is provided. While sufficient in a temporary use environment, this system still requires a relatively large effective footprint unless the user is willing to have the output merely fall to the floor.

Still another media handling system is shown in U.S. Pat. No. 5,110,111 (Gompertz et al.; assigned to the common assignee of the present invention) for an APPARATUS INCLUDING A U-SHAPED BIN HAVING A BAR GRID NETWORK FOR UNIFORMLY STACKING CUT SHEETS OF PRINTED MEDIA. A very small work space footprint is achieved in a system where printed sheets are first passed vertically downward (FIG. 1A) into a U-shaped sheet receiving bin, then allowed to "loop and flip" each sheet's trailing edge over into a stack shelf (as shown in FIG. 3). Note that this requires a printer media feed mechanism of substantial vertical height and is only suitable for media capable of bending and looping in the required manner.

Certain media, for example, photo-grade media, is not amendable to such handling.

There is a need for cut-sheet media input and output handling which will provide ease of use from an integrated, easily accessible print media input and output tray system, which will be amenable to use with virtually all forms of media, and which will present a hard copy apparatus footprint that is preferred by the end user.

SUMMARY OF THE INVENTION

In its basic aspects, the present invention provides a print media input/output tray system for a hard copy apparatus characterized by a telescoping system that includes an input tray nested with in an output tray and an output tray position detector.

The present invention is embodied in a print media tray apparatus for a hard copy apparatus having a media input mechanism. The tray apparatus includes: a first tray for receiving print media that is output by the hard copy apparatus, and a second tray for holding cut-sheet, input, print media in operative relational position to the media input mechanism, wherein the second tray means is in a nested relationship with the first tray means in a sliding fit such that when nested the first tray means and the second tray means telescope cooperatively into and out of the hard copy apparatus.

It is an advantage of the present invention that it provides a print media handling system for a hard copy apparatus with front access for both loading fresh print media and receiving printed media.

It is an advantage of the present invention that it provides a substantially planar print media input and output tray system, thereby allowing the use of print media having a variety of weight factors.

It is an advantage of the present invention that it provides user selectable output tray position options.

It is another advantage of the present invention that it allows the hard copy apparatus to have a substantially linear print media feed method and apparatus for print media input, transport through a printing or scanning station, and output.

It is another advantage of the present invention that it provides a print media output path when the hard copy apparatus is in a closed condition which reduces the necessary work space footprint of the overall hard copy apparatus.

It is yet another advantage of the present invention that it provides an output tray where printed media can be stacked consecutively during multi-sheet or batch hard copy producing operations.

It is a further advantage of the present invention that it provides an output tray which automatically provides a support surface for an input tray when the user is loading print media.

It is yet another advantage of the present invention that it provides a suitable linear input through output print media feed path for print media susceptible to undesirable curl effects.

It is still another advantage of the present invention that it allows a hard copy apparatus having a relatively short vertical form factor, or low profile, (that is, a reduced overall product height), such as can be adapted for rack mounting or use in a stereo cabinet or similar shelf-type furniture.

Other objects, features and advantages of the present invention will become apparent upon consideration of the following explanation and the accompanying drawings, in which like reference designations refer to like elements throughout.

BRIEF DESCRIPTION OF THE DRAWINGS

FIG. 6 is a perspective view—angled from above front and left—of a hard copy apparatus having the telescoping tray system in accordance with the present invention as shown in FIG. 1 with the output tray pushed in.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments and optional features are also briefly described as applicable.

In order to facilitate the explanation of the present invention, the following description will use "paper" as a generic term to indicate printable media and preprinted documents; it should be interpreted as inclusive of cut-sheet plain paper, heavier weight paper such as photo-grade paper or the like, transparencies, envelopes, pre-printed documents to be scanned, and equivalents as would be recognized by those skilled in the art. The print media loadable tray where the user would load "paper" for interface with a pick mechanism for transfer to the hard copy apparatus' paper feed mechanism will be referred to as the "input tray" or simply the "paper tray." Also to facilitate the explanation, the exemplary embodiment discussed hereinafter will be made in terms of a "printer," but it will be recognized by those skilled in the art that the invention is adaptable to many hard copy apparatus types such as copiers, facsimile machines, scanners, and the like. The use of these specific terms is not to be considered as any limitation on the scope of the invention which is set forth in the claims listed herein below.

Figure 1:
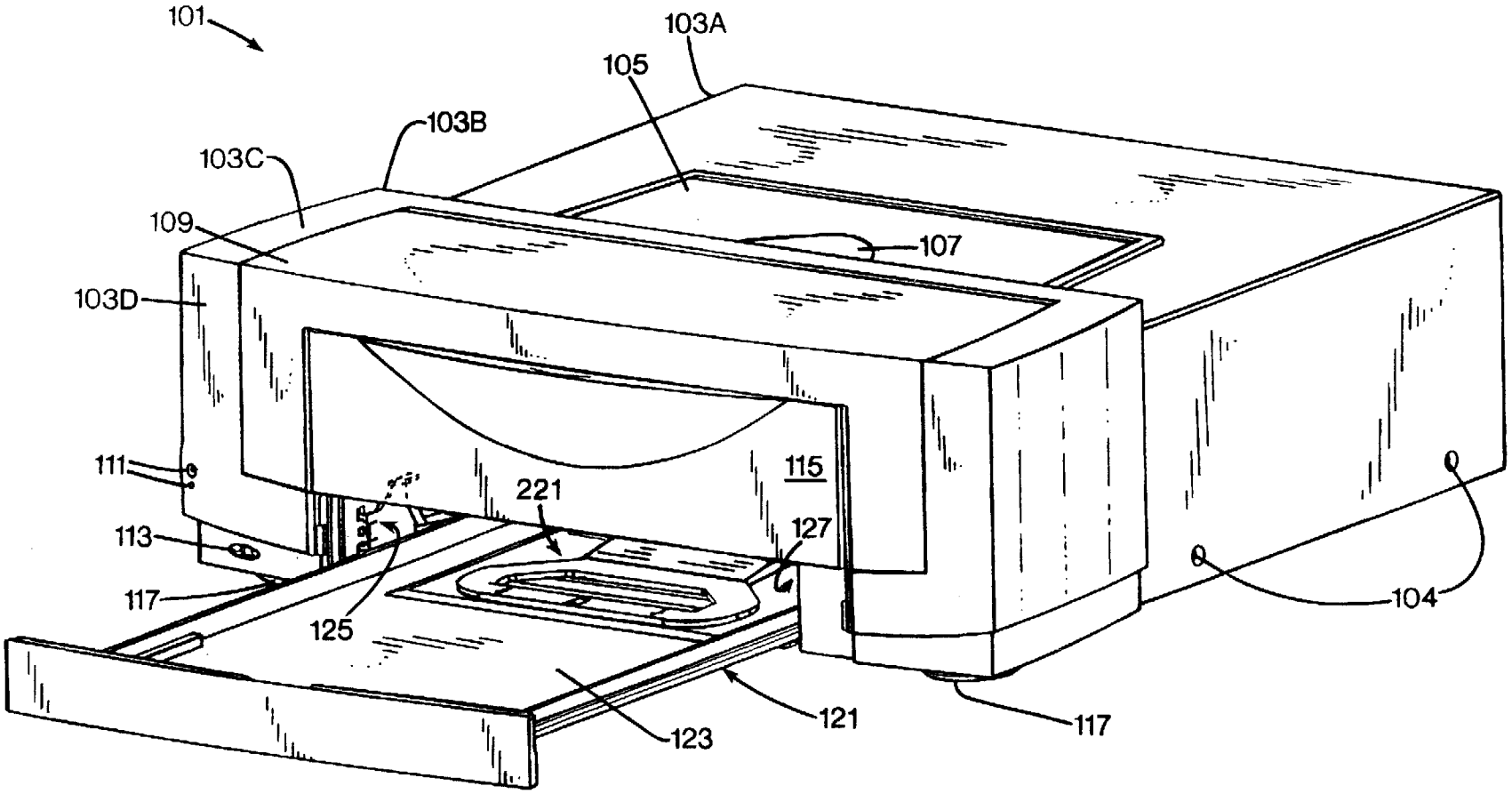
FIG. 1 is a perspective view—angled from above and front left—of a hard copy apparatus having a print media telescoping tray system in accordance with the present invention.

FIG. 1 depicts a low profile, hard copy apparatus, such as an ink-jet printer, 101 in accordance with the present invention. It is an advantage of the present invention that the footprint of this apparatus 101 can be made similar to that of a common audio-visual equipment, e.g., a VCR, stereo receiver, or the like. The apparatus 101 is therefore suitable not only for desktop use, but also can be adapted to rack-mount or stereo cabinet use. The apparatus 101 has an outer shell, or housing, 103A, 103B. The shell 103A, 103B is affixed to a base member (not shown) by suitable fastening devices 104. Outer shell portion 103A includes a lid door 105, with a finger hold 107, provided to facilitate access to the internal paper pick and feed mechanism (not shown) of the printer 101 for maintenance purposes and for clearing paper jams along the paper path.

Shell portion 103B includes a top region 103C and a front panel region 103D. An access door 109 which forms part of both the shell top region 103C and the front panel region 103D is provided to facilitate access to the ink writing apparatus (not shown), such as a print media scanning carriage having one or more replaceable pens, such as ink-jet cartridges and service stations therefor, as would be well known in the art. [The art of ink-jet technology is relatively well developed. Commercial products such as computer printers, graphics plotters, color copiers, and facsimile machines employ ink-jet technology for producing hard copy. The basics of this technology are disclosed, for example, in various articles in the *Hewlett-Packard Journal*, Vol. 36, No. 5 (May 1985), Vol 39, No. 4 (August 1988), Vol 39, No. 5 (October 1988), Vol. 43, No. 4 (August 1992), Vol. 43, No. 6 (December 1992) and Vol. 45, No. 1 (February 1994) editions, incorporated herein by reference. Ink-jet devices are also described by W. J. Lloyd and H. T. Taub in *Output Hardcopy Devices*, chapter 13 (Ed. R. C. Durbeck and S. Sherr, Academic Press, San Diego, 1988)].

The front panel region 103D of the shell portion 103B can include operational status indicators 111 and control switches, such as an ON-OFF switch 113, as fits any particular implementation. As the physical form factor of the hard copy apparatus 101 is designed to provide a low profile, front panel controls and indicators are preferred.

Yet another openable access door 115 is provided for single sheet print media insertion functioning in relation to the print media feed mechanism of the hard copy apparatus 101 as described in co-pending patent application Ser. No. 08/979,391 (Trovinger; assigned to the common assignee of the present invention), incorporated herein by reference. An understanding of that mechanism is not essential to an understanding of the present invention other than to state that the normal paper feed path through the printing station from an input tray in accordance with the present invention is a substantially linear path; that is, the paper is not wrapped around any platen, or made to follow some other relatively tortuous path as the sheet of paper traverses from the input to the output. In other words, the sheet of paper remains substantially planar through the entire path. This is advantageous in that certain printable media, such as special photo-grade paper, is susceptible to retaining any curl or to being otherwise damaged by handling.

The housing 103A, 103B is provided with footings 117 as part of the housing base (not shown) for using the apparatus 101 on a desk, table, cabinet shelf, or the like.

The telescoping tray system of the present invention is denoted generally as element 121. The telescoping tray system 121 consists of an output tray 123, a paper tray 201 (see FIGS. 2A, 2B, and 4), and an output tray position indicator 125. The printer 101 is provided with a front panel opening 127 which in conjunction with specific design implementation of the housing 103A provides a docking bay access for the telescoping tray system 121.

The apparatus 101 in a preferred embodiment is adapted to operate in two distinct modes when outputting printed media: a closed output tray mode and an open output tray mode. In the open output tray mode, the output tray 123 is positioned such that it extends outwardly from the front panel 103D of the printer 101. In the closed output tray mode position, the output tray 123 is substantially contained within the apparatus, having its front edge flush with the front panel 103D of the printer 101 with a small gap above the tray, thereby providing a paper path egress slot as will be explained in more detail hereinafter.

The output tray 123 is provided with an output tray position indicator 125 to indicated whether the output tray 123 is in the closed or open position. In the open output tray mode, the apparatus 101 is designed to stack a batch of output prints (e.g., a multiple sheet document or multiple copies of a single sheet, such as a photographic image) in the output tray 123. In the closed output tray mode, the apparatus 101 is controlled to hold each output sheet in a position that will be described hereinafter with respect to FIG. 6 and printing operations are halted until each held, output sheet is removed by the user.

The telescoping tray system and its operation are more completely explained with respect to the remaining FIGURES.

Figure 2A:
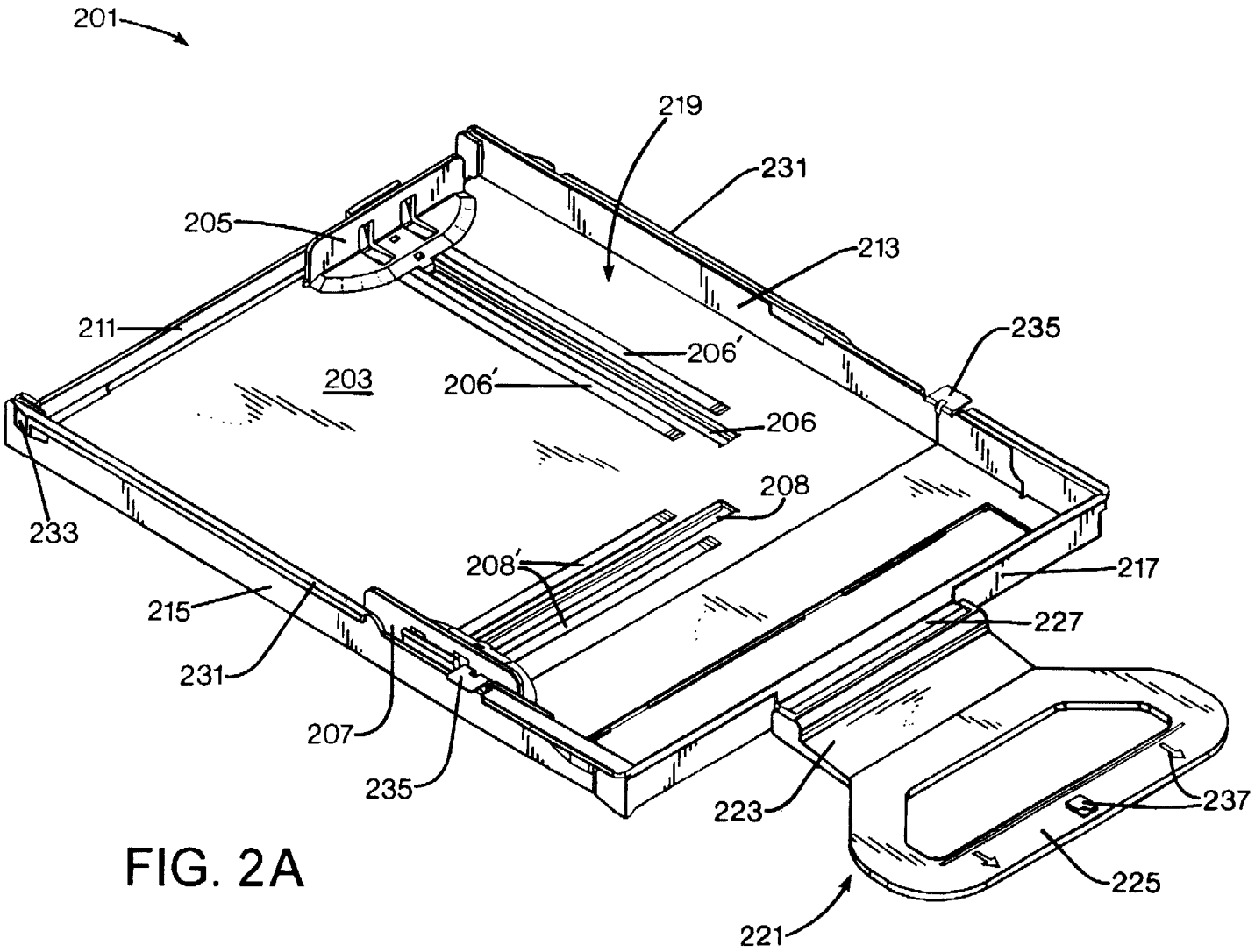
FIG. 2A is a perspective view—angled from above and front left—of a print media input tray, removed from the hard copy apparatus, in accordance with the present invention as shown in FIG. 1.
Figure 2B:
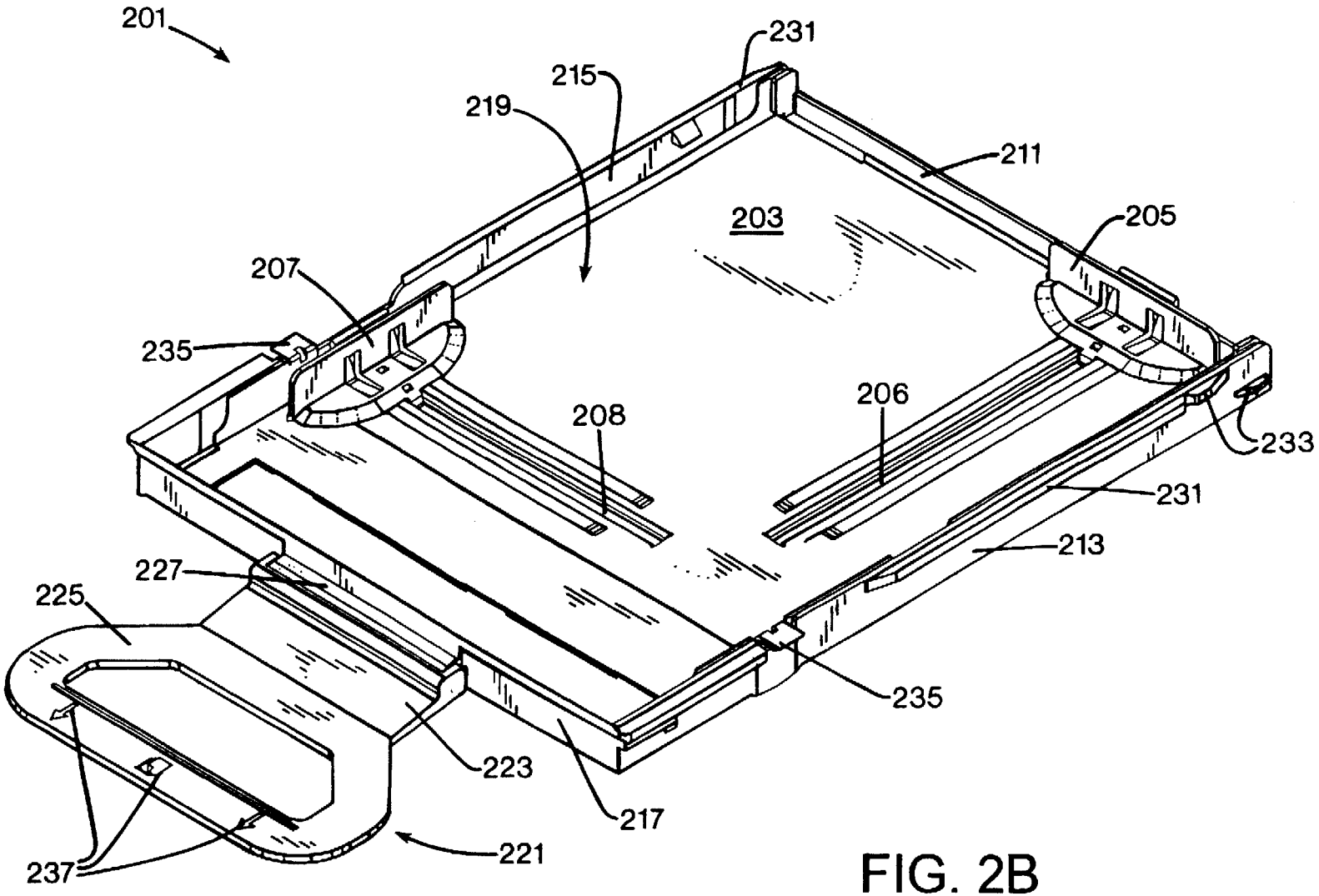
FIG. 2B is another perspective view—angled from above and front right—of the print media input tray as shown in FIG. 2A.

FIGS. 2A and 2B depict a paper tray 201 in accordance with the present invention. The paper tray 201 is constructed to have a substantially flat base plate 203 where a stack of cut sheet print media rests (not shown). Paper guides 205, 207 moveable via guide slots 206, 208, respectively, and guide tracks 206', 208', respectively, provide a user adjustment feature for sizing the paper tray to different size print media. Paper guide mechanisms are well known in the art; see e.g., U.S. Pat. No. 5,574,551, allowed Ser. No. 08/247,942 (Kazakoff; assigned to the common assignee of the present invention), incorporated herein by reference. An ascending back wall 211, two side walls 213, 215 and an ascending front wall 217 act in cooperation with the base plate 203 and paper guides 205, 207 to form a recess 219 such that a stack of paper (not shown) may be deposited onto the base plate 203 by the user and be in appropriate registration to the printer's pick and feed mechanism.

The front wall 217 is provided with a protruding handle mechanism 221. The handle mechanism 221 includes a mount 223 and a gripping member 225. The handle mechanism 221 is designed preferably to have at least a limited degree of motion in the vertical direction relative to the base plate 203. Thus, the mount 223 can be attached to the front wall 217 by a hinge 227 or some other flexible means—such as by using a soft plastic or rubber construction—that will provide at least enough vertical motion freedom to allow proper gripping when the paper tray 201 is nested with the output tray 123 as will be described in more detail with respect to FIGS. 3A, 3B and 4. Referring briefly to FIG. 1, note that the handle mechanism 221 is positioned to be reachable by a user when the output tray 123 is extended but the paper tray 201 is fully inserted into its operational position.

The ascending walls 211–217 of the paper tray 201 are provided with appropriate external rails 231, bosses 233, detents 235, and the like, as are necessary for a particular implementation in order to integrate the paper tray with both the output tray 123, as will be explained in more detail hereinafter, and with the paper pick and feed mechanism.

Figure 3A:
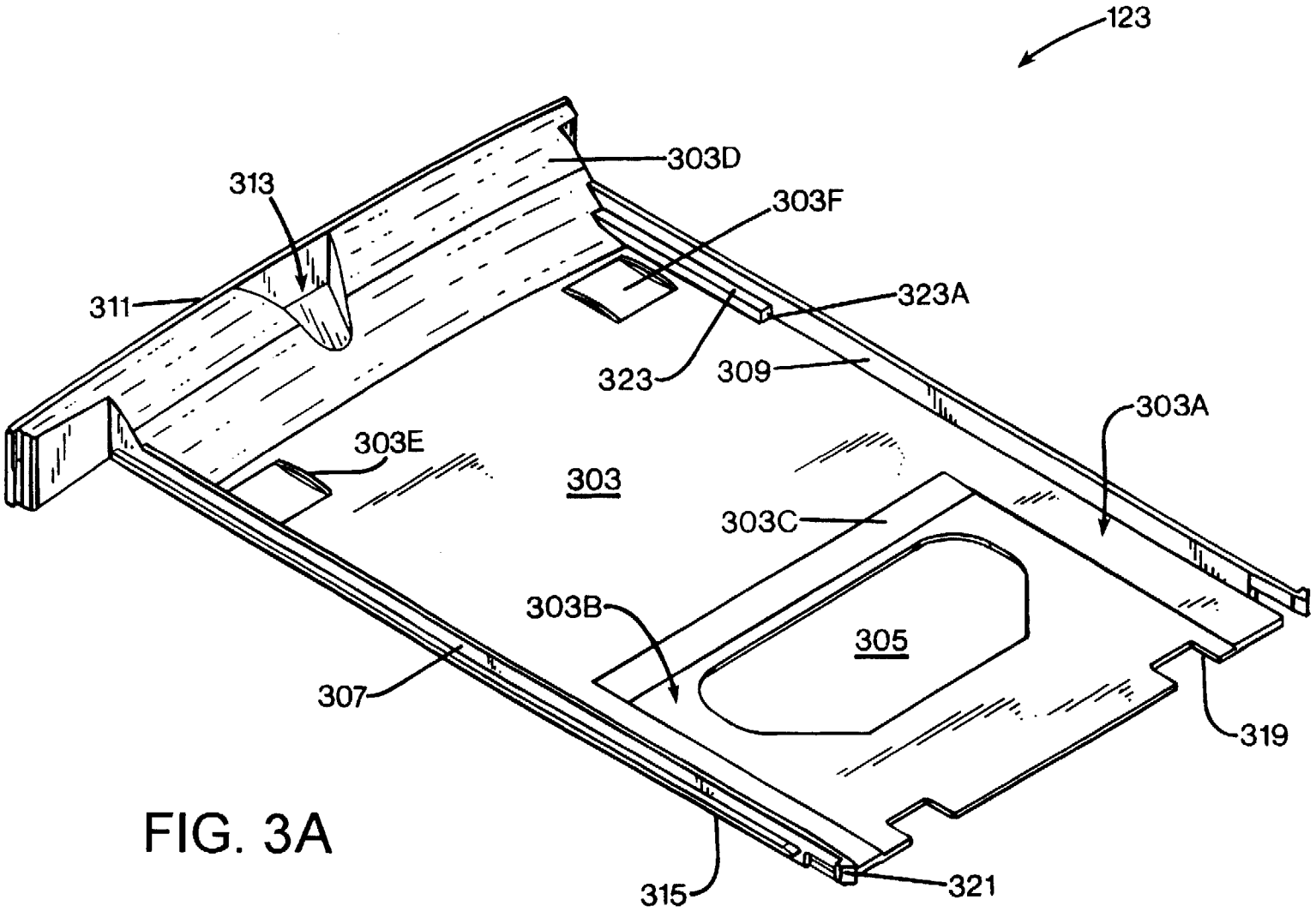
FIG. 3A is a perspective view—angled from above and rear, apparatus right—of a print media output tray, removed from the hard copy apparatus, of the present invention as shown in FIG. 1.
Figure 3B:
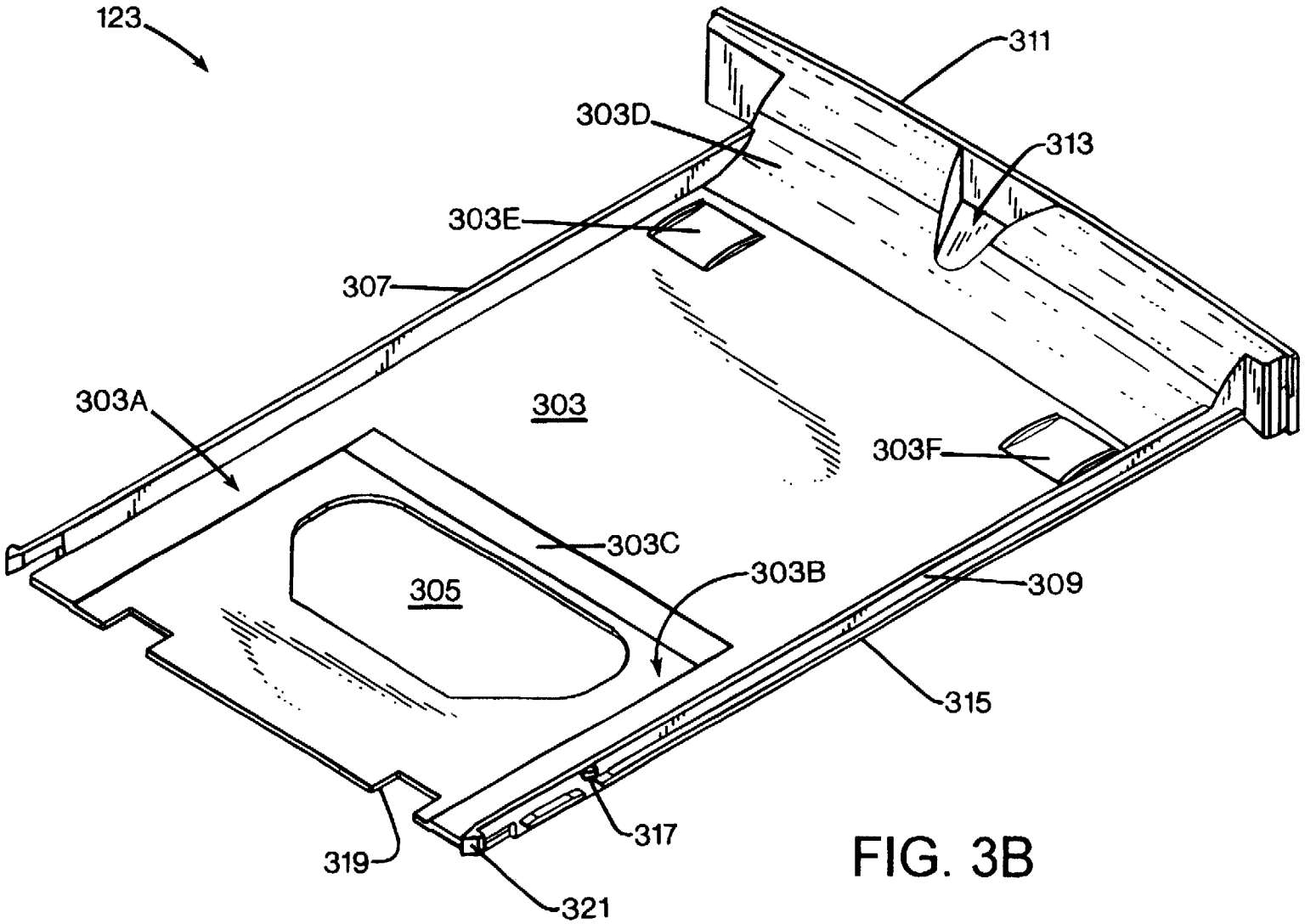
FIG. 3B is a perspective view—angled from above and rear, apparatus left—of the print media output tray as shown in FIG. 3A.

Turning now to FIGS. 3A and 3B, the output tray 123 is shown in detail. The output tray 123 includes a substantially planar base 303. A rearward area 303A of the planar base 303 includes a slight depression region 303B. Depression region 303B includes a recess or a cut-out region, or aperture, 305. The aperture 305 is essentially the same shape as, but very slightly larger than the gripping member 225 of the handle mechanism 221. Referring again briefly to FIG. 1, it will be recognized that the handle mechanism of the gripping member 225 seats into the aperture 305 when the output tray 123 is fully extended. Referring briefly to FIGS. 2A and 2B, labels 237 can be provided to facilitate user understanding of functionality, e.g., arrows to show pulling direction. Returning to FIGS. 3A and 3B, a ramp region 303C located immediately forward of the aperture 305 induces the raising of the gripping member 225 via the mount portion 223 when the output tray 123 is pushed inwardly, namely for closed output tray operation or non-use storage.

The output tray 123 has ascending side walls 307, 309 and an ascending front wall 311. No rear wall is provided in order to permit telescoping between the paper tray 201 and the output tray 123. Between the front wall 311 and the output tray base plate 303, a upwardly recurved region 303D is provided which aids the paper in exiting the printer when the operation is in the output tray closed mode, as will also be further explained with respect to FIG. 6 hereinafter. Two print media ramps 303E, 303F, inwardly adjacent the recurved region 303D lift the leading edge of a sheet of print media being output by the hard copy apparatus feed mechanism from the printing station when the printer 101 is operated in the output tray closed mode. The recurved region 303D may also be provided with a centrally located depression 313 which acts as a finger hold for the user when pulling the output tray 123 out of the opening 127 (FIG. 1) of the printer 101.

External rails 315, bosses 317, detents 319, catches 321, and the like may be provided as necessary to adapt an output tray 123 in accordance with the present invention to a specific printer design implementation, that is, to provide a properly integrated fit with the shell 103A-D and its base. Boss 317 has a specific function as will be described with respect to FIGS. 7A and 7B hereinafter.

Figure 4:
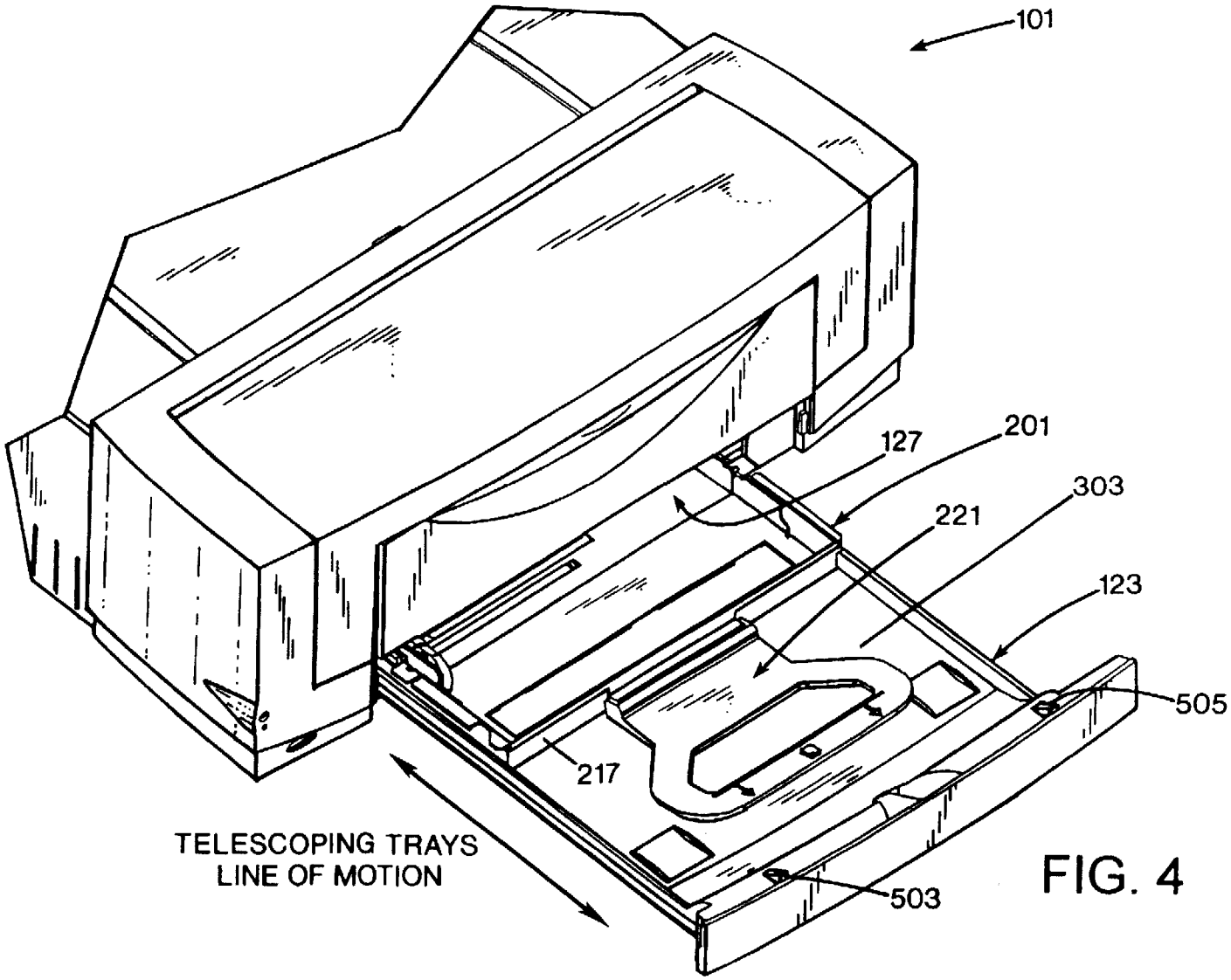
FIG. 4 is a perspective view—angled from above front and left—of a hard copy apparatus, in partial cut-away, in accordance with the present invention as shown in FIG. 1 with the input tray partially pulled out whereby print media can be loaded therein.

A push bar 323 (FIG. 3A only) is provide on the base plate 303, adapted to contact the paper tray 201 front wall 217 when the paper tray 201 is nested in the output tray 123 as shown in FIG. 4.

The paper tray 201 is designed with specific external dimensions such that it nests within the output tray 123 in a close tolerance, sliding fit. Close tolerances provide both paper pick and feed accuracy and also substantially eliminate vibrational noise that might occur during printing cycles. To load the paper tray 201 with print media, the user would pull the output tray 123 to its fully-extended, open position along the "telescoping trays line of motion" as indicated by the labeled arrow of FIG. 4. Now referring briefly to FIG. 1, with the output tray 123 fully extended, the user would find the handle mechanism 221 seated in the output tray aperture 305 (FIGS. 3A, 3B) in a reachable position. Reaching into the front panel opening 127, the user grasps the gripping member 225 of the handle mechanism 221, lifts it slightly to release it from the aperture 305, and pulls the paper tray 201 slidingly along the base plate 303 of the output tray 123. Note that while the paper tray 201 can be completely removed, it is not necessary to do so to load or change print media. As shown in FIG. 4, the paper tray 201 can be pulled forward at least as far as until the paper tray 201 front wall 217 contacts the end 323A of push bar 323 (FIG. 3A). Further removal of the paper tray 201 would require lifting it off of the base plate 303 (FIGS. 3A, 3B) of the output tray 123. It is an advantageous aspect of the present invention that with the paper tray 201 still nested as shown in FIG. 4, sufficient room has been provided for the user to load or change print media. Should the user wish to change the size of the print media, the paper tray 201 is exposed to the extent where the paper width guide 207 is accessible or the paper tray 201 is easily liftable out of the output tray 123 so that the user can use both the guide mechanisms 205, 207 accordingly. Thus, another advantage of the system is that the print media input tray 201 is accessible via the access for replenishment of print media, including loading, changing, and some sizing capability without complete removal of the paper tray 201 being required.

Once the trays 123, 201 are properly nested, simply by sliding the output tray 123 closed along the "telescoping trays line of motion," the contact between the push bar end 323A (FIG. 3A) of the output tray 123 and the front wall 217 of the paper tray 201 force the paper tray 201 to be returned to its operative station, namely where the printer media pick and feed mechanism is positioned appropriately to the leading edge of the loaded print media.

Figure 5:
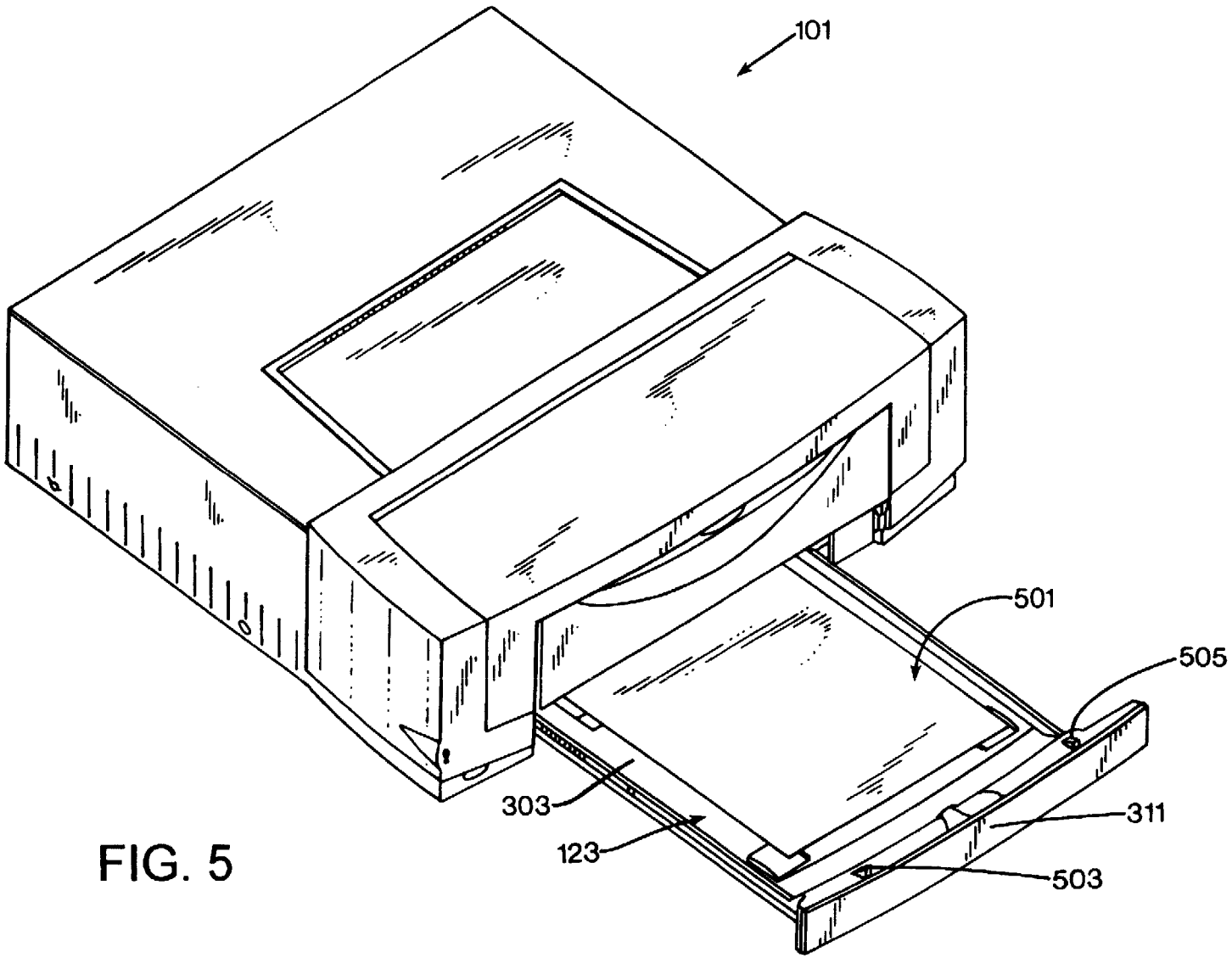
FIG. 5 is a perspective view—angled from above front and left—of a hard copy apparatus having the telescoping tray system in accordance with the present invention as shown in FIG. 1 with the output tray extended.
Figure 6:
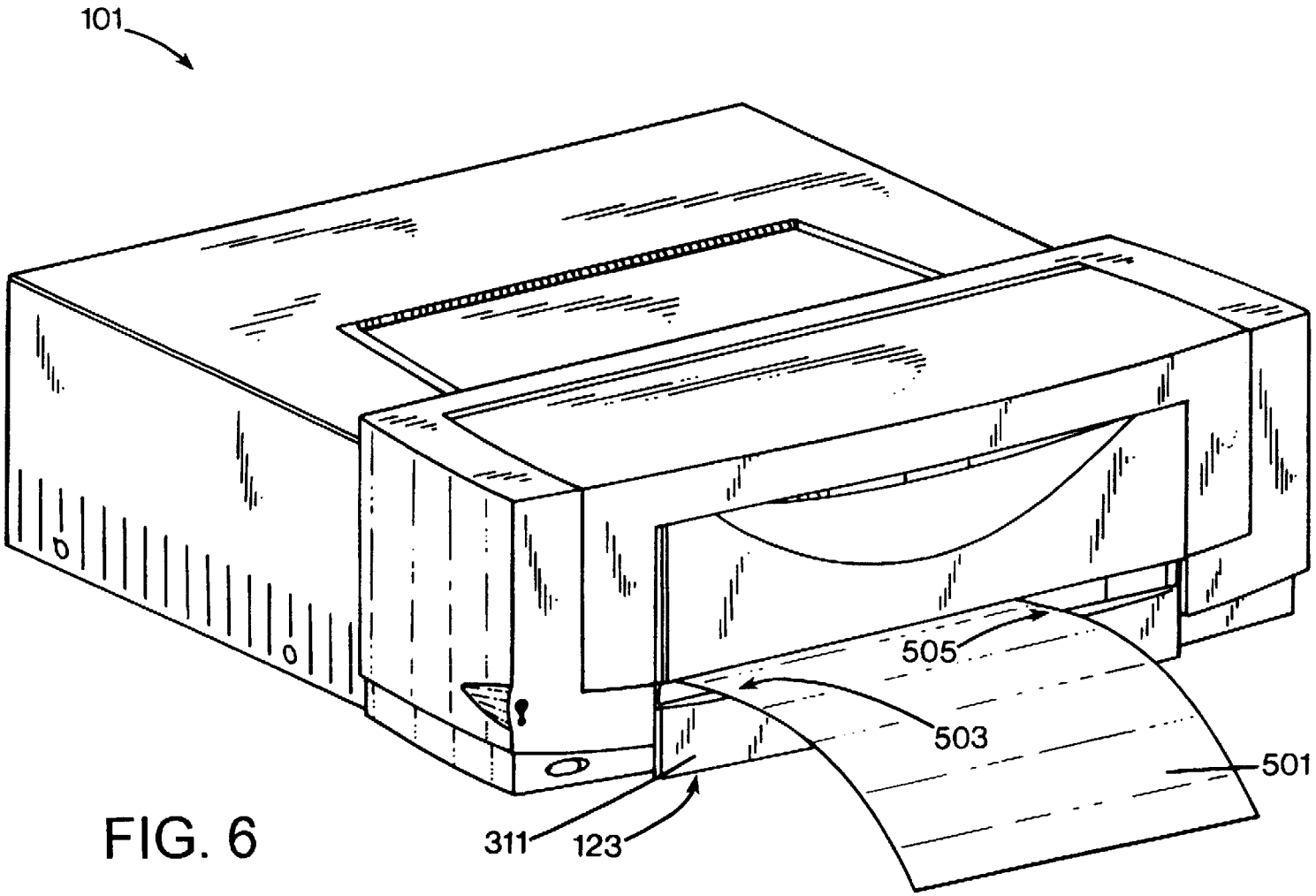

FIGS. 5 and 6 show, in comparison, the two modes of operation of the printer 101: the open output tray mode is shown in FIG. 5 and the closed output tray mode in FIG. 6. In the open output tray mode a printed sheet of paper 501 is deposited by the paper feed mechanism onto the base plate 303 of the output tray 123. As described with respect to FIG. 1, and detailed with respect to FIGS. 7A and 7B hereafter, the output tray position indicator 125 has flagged the printer controls such that batch printing can continue without further user interaction. In other words, successive print copies will be deposited on top of printed sheet of paper 501. In the closed output tray mode, as the printed sheet of paper 501 is ejected by the paper feed mechanism of the printer 101, its leading edge is forced upwardly and outwardly by the output tray media ramps 303E, 303F (FIGS. 3A, 3B) and upwardly by the recurved region 303D of the output tray 123. In the closed output tray mode, the printer 101 feed mechanism may be used to hold the output printed sheet of paper 501 as shown in FIG. 6 and, because of the output tray position indicator 125, the printer 101 will not continue printing until the printed sheet is removed by the user.

Optionally, two protruding fangs 503, 505 rise up from the front wall 311 of the output tray 123. During closed tray operation, these two fangs 503, 505 shape the printed sheet of paper 501, creating a transverse bowing, to ensure the sheet does not fall from the output tray 123 during the output tray closed mode of operation.

Figure 7A:
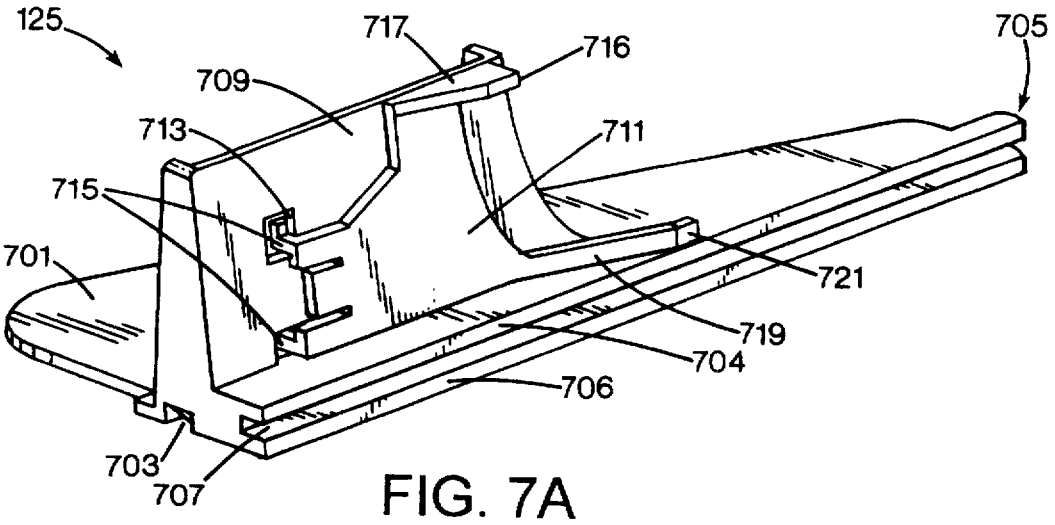
FIGS. 7A and 7B are perspective views—angled from above front and right—of detail of a flag mechanism of the telescoping tray system in accordance with the present invention as shown in FIG. 1.
Figure 7B:
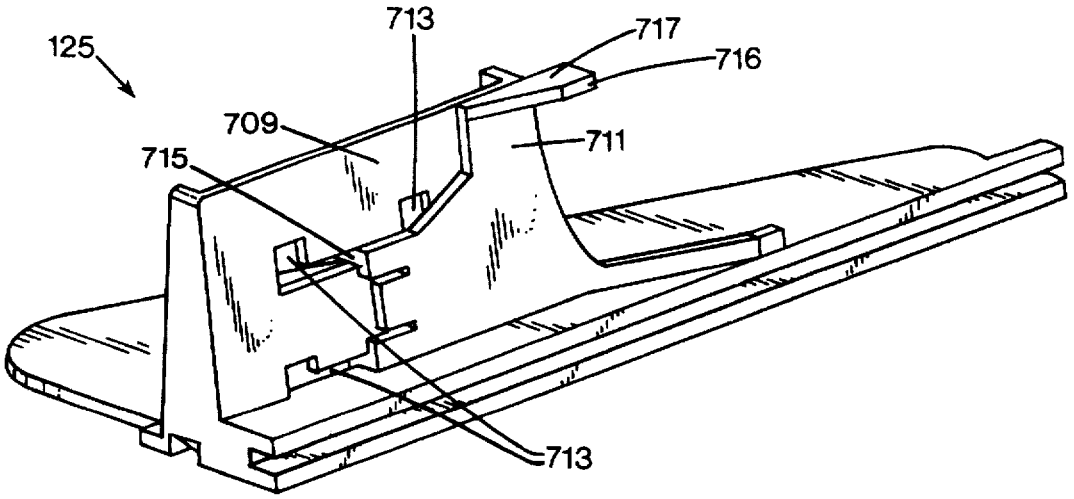

An output tray position indicator 125 (FIG. 1) is a mechanism for providing an electronic indication, a "flag," which is useful in determining appropriate print media transport functions. FIGS. 7A and 7B show detail of a commercial embodiment, however, it will be recognized by those skilled in the art that a variety of mechanisms for providing an equivalent function are available. FIG. 7A shows the indicator in a forward position—toward the front panel 103D when the output tray 123 is in the fully open position as shown in FIG. 1. FIG. 7B shows the output tray position indicator 125 in a backward position, that is the indicator's position when the output tray 123 is closed as depicted in FIG. 6. [Note that while the indicator 125 is shown as a separate piece part, an indicator 125 can also be formed integrally with the housing or other mechanisms of the apparatus as may be commercially expedient.] A base 701 has appropriate shape and mounting detents 703 as suit a particularly mounting implementation. A base railing 705, having an upper rail 704 and a lower rail 706, provides a slot 707 between the upper rail 704 and the lower rail 706 for accommodating a sliding fit with the output tray guide rail 315 (FIG. 3B). The base 701 has a riser 709 for supporting a movable flag 711. The movable flag 711 is biased, such as by a spring (not shown), to the position shown in FIG. 7B. The riser 709 provides mounting slots 713 through which mounting arms 715 of the riser 709 are catch-fit to allow the flag 711 to slide between two indicating positions: output tray open—FIG. 7A—and output tray closed—FIG. 7B. The flag 711 has an extension arm 719 positioned superjacent upper rail 704 with an extension arm mechanical contact end 721 located so that it will come into contact with boss 317 (FIG. 3B) of the output tray 123 as the output tray 123 is pulled from its closed position to its open position. The flag 711 has a generally horizontal cantilever 716. The cantilever 716 is provided with a reflective top surface 717. As the flag 711 is moved, from the position shown in FIG. 7A to a position shown in FIG. 7B by the action of pulling out the output tray 123, the boss 317 contacts the extension arm mechanical contact end 721. Further motion exerts a force on the contact end 721, the flag 711 slides from its position as shown in FIG. 7B to its position as shown in FIG. 7A. The cantilever 716 is therefore shifted so that a sensor, such as a reflective-triggered optical sensor, (not shown; a commercially available sensor such as a reflective sensor manufactured by Honeywell™ as part no. HCL1395 will work in accordance with the operating parameters of the present invention), mounted and electrically connected appropriately as part of the internal printing station (not shown) of the printer 101 is triggered to sense the output tray positional change. A signal is thus generated as to whether the output tray 123 is extended or retracted. Further detail is not necessary herein to an understanding of the present invention. Such a signal could be useful to other systems of the particular hard copy apparatus in which the present invention is implemented. For example, when the output tray is closed, FIG. 7B, a signal is generated by the sensor based upon the output tray position indicator 125, a printed sheet should not be released by the print media pick and feed mechanism of the printer 101 or it will simply fall onto the work space or floor if the printer is positioned at the edge of the work space.

In an alternative embodiment, an electromechanical drive device such as a simple motor and transmission as would be known in the art (not shown) and a front panel control for the drive can be added to drive the output tray 123 selectively into and out of the printer along the telescoping trays line of motion.

Thus, a media tray system with total hard copy apparatus front panel access is provided. In the output tray open mode, the output tray 123 can hang over the edge of a shelf or the like. The output tray 123 can be retracted into the docking bay during non-use or when only a single sheet print media output use is instigated. Thus, a telescoping tray system for a hard copy apparatus is presented which reduces the work space footprint which would otherwise be required with a fixed output tray.

The foregoing description of the preferred embodiment of the present invention has been presented for purposes of illustration and description. It is not intended to be exhaustive of the scope of the invention. Obviously many ed in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A print media tray apparatus for a hard copy apparatus having a media input mechanism, said tray apparatus comprising:

first tray means for receiving print media output by the hard copy apparatus; and second tray means for holding cut-sheet, input, print media in operative relational position to said media input mechanism, wherein said second tray means is in a nested relationship with said first tray means in a sliding fit such that when nested said first tray means and said second tray means telescope cooperatively into and out of said hard copy apparatus.

2. The apparatus as set forth in claim 1, further comprising:

said first tray means and said second tray means operate in either an open output tray operational mode and a closed output tray operational mode, and, when nested, are telescopically received within said hard copy apparatus such that in said closed output tray operational mode, both said first tray means and said second tray means are contained within said hard copy apparatus.

3. The apparatus as set forth in claim 2, further comprising:

in said open output tray operational mode, said first tray means extends outwardly from said hard copy apparatus via a substantially linear line of motion with respect to said second tray, said second tray means remaining in said operative relational position to said media input mechanism.

4. The apparatus as set forth in claim 3, further comprising:

said second tray means is removable from said nested relationship; and handle means for gripping said second tray means attached to a leading edge of said second tray means.

5. The apparatus as set forth in claim 4, wherein said first tray means further comprises:

a substantially planar region for receiving print media output by said hard copy apparatus in said open output tray operational mode; and means for directing a leading edge of a sheet of output print media upwardly from said planar region such that said sheet is directed outwardly from said hard copy apparatus in said closed output tray operational mode.

6. The apparatus as set forth in claim 5, wherein said substantially planar region further comprises:

means for receiving said handle means such that said handle means is recessed into said substantially planar region.

7. The apparatus as set forth in claim 5, wherein said means for directing further comprises:

a ramp angled upwardly from said planar region for directing a leading edge of a sheet of output print media outwardly from said said hard copy apparatus when in said closed output tray operational mode.

8. The apparatus as set forth in claim 7, wherein said ramp further comprises:

means for shaping output print media such that in said closed output tray operational mode said output print media is shaped to inhibit bending in a manner which would allow said output print media to fall from said hard copy apparatus.

9. The apparatus as set forth in claim 3, wherein said first tray means further comprises:

means for forcing said second tray means to said operative relational position when said second tray means is nested within said first tray means when said first tray means is moved from said open tray operational mode position to said closed tray operational mode position.

10. The apparatus as set forth in claim 3, further comprising:

means for sensing whether said second tray is in a fully extended position indicative of said open tray operational mode or in a position indicative of said closed tray operational mode.

11. A print media input/output tray system for a cut-sheet print media hard copy apparatus, said apparatus having a print media pick and feed mechanism and a housing including a front panel provided with an opening adapted for use with said tray system, said tray system comprising:

a first tray for receiving output print media from said print media pick and feed mechanism, said first tray being mounted with respect to said front panel to have at least two operational mode positions, a first position wherein said first tray extends horizontally outward from said front panel and a second position wherein said first tray is substantially contained within said opening having a front edge panel substantially flush with said front panel;

a second tray for holding a stack of cut-sheet print media therein;

wherein said second tray has shape and dimensions such that in operational modes said second tray is cooperatively nested within said first tray in a sliding relationship thereto and is positioned with respect thereto in a print media feed operational position for delivering sheets of print media to said pick and feed mechanism when said first tray is in either said first position or said second position, and further, said second tray is accessible through said opening when said first tray is in said first position such that said first tray and said second tray form a telescoping tray system adapted for access and use from said front panel.

12. The system as set forth in claim 11, further comprising:

means for indicating whether said first tray is in said first position or said second position.

13. The system as set forth in claim 11, wherein said second tray means further comprises:

a handle mechanism protruding from a leading wall of said second tray for facilitating moving of said second tray from said print media feed operational position.

14. The system as set forth in claim 11, wherein said first tray further comprises:

a substantially planar region for receiving multiple sheets of output print media when said first tray is in said first position; and means for lifting a leading edge of output print media delivered from said pick and feed mechanism of said hard copy apparatus when in said second position.

15. The system as set forth in claim 14, wherein said first tray comprises:

a receptacle within said substantially planar region for receiving at least a portion said handle mechanism therein when said first tray is in said first position such that planarity of said region is maintained; and said means for lifting further comprises a recurved ramp inwardly adjacent said front edge panel and angled upwardly from said planar region such that when said first tray is in said second position, a sheet of output media from said pick and feed mechanism has a media leading edge directed upwardly from said first tray and outwardly from said front panel.

16. The system as set forth in claim 12, further comprising:

when said means for indicating provides an indication that said first tray is in said second position, a sheet of print media output by said pick and feed mechanism is partially retained within said first tray and is partially protruding from said front panel.

17. The system as set forth in claim 11, wherein said first tray further comprises:

means for automatically moving said second tray to said print media feed operational position as said second tray is nested within said first tray when said first tray means is moved from said first position to said second position.

18. In a hard copy apparatus having a housing, said housing having a front panel and containing a cut-sheet print media pick and feed mechanism, a printing station mechanism for receiving consecutive sheets of print media, and a mechanism for detecting a plurality of output modes, a print media telescoping tray system comprising:

a print media tray bay in said housing, having an access via said front panel;

a print media output tray, said output tray having a substantially linear range of motion into and out of said bay via said access;

a refillable print media input tray, nested with said output tray such as to have a telescoping line of motion and capability with respect thereto and adapted to hold a replenishable stack of cut-sheet print media positioned to be picked from said stack by said pick and feed mechanism to be transferred in a substantially linear path from said stack into said printing station mechanism wherein said path is generally parallel to said linear range of motion of said output tray;

said apparatus providing an output tray open mode of operation and an output tray closed mode of operation; and an indicating mechanism for indicating whether said apparatus is operating in said output tray open mode of operation or said output tray closed mode of operation.

19. The system as set forth in claim 18, further comprising:

said print media input tray is accessible via said access for replenishment of print media without removal from said nested configuration by sliding said input tray forwardly in a telescoping motion toward said front panel along said substantially linear range of motion.

20. The system as set forth in claim 18, further comprising:

said output tray having a substantially planar region for receiving and stacking consecutive sheets of print media from said printing station when said apparatus is in said output tray open mode as indicated by said indicating mechanism; and said output tray further having a means for directing an output sheet of print media outwardly from said front panel when said apparatus is in said output tray closed mode.

* * * * *